US012398337B2

(12) United States Patent
Han et al.

(10) Patent No.: US 12,398,337 B2
(45) Date of Patent: Aug. 26, 2025

(54) TRIBLOCK POLYALKYLENE GLYCOLS FOR TWO PHASE LUBRICANTS

(71) Applicant: Dow Global Technologies LLC, Midland, MI (US)

(72) Inventors: Yaokun Han, Shanghai (CN); Martin R. Greaves, Baar (CH); Paolo Sabatino, Middelburg (NL); Ingrid Govaert, Goes (NL)

(73) Assignee: Dow Global Technologies LLC, Midland, MI (US)

( * ) Notice: Subject to any disclaimer, the term of this patent is extended or adjusted under 35 U.S.C. 154(b) by 0 days.

(21) Appl. No.: 18/712,836

(22) PCT Filed: Feb. 23, 2022

(86) PCT No.: PCT/CN2022/077417
§ 371 (c)(1),
(2) Date: May 23, 2024

(87) PCT Pub. No.: WO2023/159376
PCT Pub. Date: Aug. 31, 2023

(65) Prior Publication Data

US 2025/0019612 A1 Jan. 16, 2025

(51) Int. Cl.

| | |
|---|---|
| ***C10M 107/34*** | (2006.01) |
| ***C10M 111/04*** | (2006.01) |
| *C10N 20/00* | (2006.01) |
| *C10N 20/02* | (2006.01) |
| *C10N 20/04* | (2006.01) |

(52) U.S. Cl.
CPC ..... *C10M 107/34* (2013.01); *C10M 111/04* (2013.01); *C10M 2203/003* (2013.01); *C10M 2209/1033* (2013.01); *C10M 2290/00* (2013.01); *C10N 2020/017* (2020.05); *C10N 2020/02* (2013.01); *C10N 2020/04* (2013.01)

(58) Field of Classification Search
CPC ..... C10M 107/34; C10M 111/04; C10M 2203/003; C10M 2209/1033; C10M 2290/00; C10N 2020/017; C10N 2020/02; C10N 2020/04
See application file for complete search history.

(56) References Cited

U.S. PATENT DOCUMENTS

| | | | | |
|---|---|---|---|---|
| 5,602,085 | A | 2/1997 | Peterson et al. | |
| 8,969,271 | B2 | 3/2015 | Greaves et al. | |
| 2012/0108482 | A1* | 5/2012 | Greaves | C10M 111/04 508/579 |
| 2014/0194332 | A1* | 7/2014 | Kamata | C10M 111/04 508/532 |
| 2014/0249063 | A1* | 9/2014 | Greaves | C10M 111/04 508/579 |
| 2016/0060561 | A1 | 3/2016 | Greaves et al. | |
| 2018/0030370 | A1* | 2/2018 | Kotnis | C10M 161/00 |
| 2018/0245017 | A1* | 8/2018 | Kotnis | C10M 169/044 |
| 2024/0052254 | A1* | 2/2024 | Lizarraga-Garcia | C10M 169/04 |

FOREIGN PATENT DOCUMENTS

| | | | |
|---|---|---|---|
| EP | 1052282 | 11/2000 | |
| EP | 2888345 B1 * | 12/2020 | C10M 169/041 |
| FR | 2205931 | 5/1974 | |

OTHER PUBLICATIONS

Greaves, Oil Soluble Polyalkylene Glycols, Lube Magazine, 2013, No. 118, pp. 22-27.

Kamata, "The Development to Control Simultaneously Both Viscosity and Separation Temperature of a Two Phase Lubricant for Practical Use," Tribology Online, 2016, vol. 11, No. 1 pp. 24-33.

* cited by examiner

*Primary Examiner* — Ellen M McAvoy

(57) ABSTRACT

A composition of matter that exhibits two phases at lower temperatures (for example, less than about 50° C.) but only one-phase at higher temperatures (for example, above about 90° C.) is disclosed. The compositions comprise a low viscosity base oil which is a hydrocarbon oil and the high viscosity base oil which is a triblock polyalkylene glycol derived from a copolymer of 1, 2-propylene oxide and 1, 2-butylene oxide in which the PO/BO ratio is from 25/75 to 90/10 percent by weight and has a polymerization sequence of PO-BO-PO.

12 Claims, No Drawings

TRIBLOCK POLYALKYLENE GLYCOLS FOR TWO PHASE LUBRICANTS

FIELD

The present invention pertains to a new class of materials suitable use for use as lubricants. These materials are triblock polyalkyene glycols and, when blended with hydrocarbon oils, tend to exhibit two phases at one temperature and single phase at a different temperature.

INTRODUCTION

Lubricants for industrial uses are usually single phase, constant composition materials made of basestocks to which various performance enhancing additives may be incorporated. Typically, a lubricant is selected to optimize the performance, function and protection of lubricated systems under intended conditions of use, such as gears, cam-follower pairs, roller bearings, hydrodynamic bearings or pumps.

To optimize system performance, the lubricant is formulated by selecting one or more basestocks and additives which will meet system needs when combined. Viscosity properties are an important consideration when formulating a lubricant because the appropriate viscosity balances energy loss (because of viscous drag) with wear (because of diminished oil film thickness and reduced viscosity). Anti-wear and antiscuff additives can help protect surfaces when the oil film between such surfaces becomes too thin. Basestocks, depending on their composition, can have various beneficial properties such as antioxidancy, good viscosity index and low traction.

While it is possible to optimize lubricant selection for a single phase lubricant, optimum performance under the prevailing operating conditions (such as speed, load and temperature) can be compromised when the conditions change or when the same lubricant is used to lubricate several parts, each part having its own unique lubricant needs. Frequently, one lubricant is used to lubricate a wide variety of machines, for the sake of simplicity.

The use of a single phase lubricant requires a compromise between premature machine failure due to wear, fatigue or scuffing, because the lubricant is of insufficient viscosity under one set of operating conditions, with excessive energy loss or overheating, because the lubricant viscosity is too high for a second set of operating conditions. Since machine or plant operators prefer to minimize downtime, the compromise usually favors high viscosity lubricants which reduce equipment failure but cause excess energy loss in periods of startup when temperatures are lower. Where temperatures vary widely over the intended use of the lubricant, the viscosity is typically optimized for use at its highest operating temperature, but because of the relationship between viscosity and temperature, much energy is wasted since the lubricant viscosity is too high under the normally lower operating temperatures.

There has been significant innovation into developing lubricants that offer energy efficient benefits which can improve fuel economy. This means that less energy is consumed in operating equipment when a more energy efficient lubricant is chosen. One way of improving efficiency is to reduce frictional losses in equipment by developing lubricants which lower the friction between moving parts. This can be achieved by using friction modifiers as an example and/or choosing base oils with inherently low friction values. A second way is simply to lower the viscosity of the lubricant. Lower viscosity lubricants consume less energy in lubricant internal friction. However, when the viscosity of the lubricant becomes too low, excessive wear can occur which can ultimately result in equipment damage due to inadequate amount of lubricant film thickness.

Two-phase lubricants for improving the low temperature starting of an automobile engine are disclosed in French Patent No. 2,205,931 and in U.S. Pat. No. 5,602,085. In these references, a process is disclosed in which a more dense lower viscosity phase and a less dense higher viscosity phase are combined such that a homogeneous phase, with lubricating properties characteristic of conventional engine lubricants, exists when the engine is at its operating temperature. When the engine is cool, the phases separate so that on starting the engine under low temperature conditions only the low viscosity more dense fluid is drawn into the oil pump. This improves engine cranking speeds because of reduced viscous drag and provides easier starting. The lubricant phases mix as the engine warns-up and the mixed lubricant behaves in the conventional manner, demonstrating large viscosity variations with temperature.

The lubricant should consist of a high viscosity base oil and a low viscosity base oil, and the high viscosity base oil should have a higher density than the lower viscosity base oil. At low temperatures, and under static conditions (for example when equipment is not operational), the high viscosity base oil separates and forms the lower layer. The low viscosity base oil (which has a lower density) forms the upper layer.

It is well known that when equipment starts up, there is significant energy consumed when conventional one-phase lubricants are pumped around equipment (one phase lubricants remain one phase across a wide operational temperature range). Energy losses due to viscous drag can be significant as the lubricant is cold and more viscous (than at high temperature).

In equipment such as a gear or transmission system, during equipment start-up, the gear will begin to spin in the lubricant. But at equipment start-up, when the temperature is cold (for example, 20° C.), if the lubricant exists as a two-phase lubricant, the gear will initially spin in the low viscosity base oil (upper phase). Thus, the churning energy losses are much lower than if the lubricant was homogeneous (one phase) and existing as a higher viscosity fluid. This concept can improve energy efficiency through lubricant design and a method of lubricating the equipment. As the lubricant temperature increases due to heating caused by friction, the lubricant forms one-phase as the higher viscosity base oil and lower viscosity base oil mix and become miscible in each other.

Moreover, it is well known that conventional lubricants, which are homogeneous (one phase) at both low and higher temperatures, show a viscosity decrease as the lubricant temperature increases and thus the lubricant film thickness becomes thinner thereby increasing the probability of wear between rubbing surfaces. But in the two-phase system, at higher temperatures, the high viscosity base oil mixes with the low viscosity base oil, to create a more viscous lubricant offering a thicker film thus helping prevent wear occurring.

Therefore, novel lubricant solutions or methods of using novel lubricant solutions are desired that can provide improved energy efficiency over conventional lubricants while also achieving the primary goal of minimizing wear.

New materials which can achieve a balance of energy efficiency as well as long term wear resistance are continuously sought.

SUMMARY

The present invention relates to a composition of matter that exhibits two phases at lower temperatures (for example, less than about 35° C.) but only one-phase at higher temperatures (for example, above about 90° C.). The compositions comprise a low viscosity base oil which is a hydrocarbon oil and the high viscosity base oil which is a triblock polyalkylene glycol derived from a copolymer of 1,2-propylene oxide and 1,2-butylene oxide in which the PO/BO ratio is from 25/75 to 90/10 percent by weight and has a polymerization sequence of PO-BO-PO.

DETAILED DESCRIPTION

The present invention relates to a composition of matter that exhibits two phases at lower temperatures (for example, less than about 30° C., 40° C., or even 50° C.) but only one-phase at higher temperatures (for example, above about 100° C., 95° C., or even 90° C.). The compositions of the present invention comprise a low viscosity base oil which is a hydrocarbon oil and the high viscosity base oil which is a triblock polyalkylene glycol derived from a copolymer of 1,2-propylene oxide and 1,2-butylene oxide in which the PO/BO ratio is from 25/75 to 90/10 percent by weight and has a polymerization sequence of PO-BO-PO.

The composition of matter, or lubricant system of the present invention comprises two main components; a low viscosity base oil which is a hydrocarbon oil and a high viscosity base oil which is an ABA triblock polyalkylene glycol derived from 1,2-propylene oxide as the A units and 1,2-butylene oxide as the B units. Block polymers are well known in the art and are to be distinguished from random polymers in which the units derived from PO and the units derived from BO are polymerized at the same time resulting in a random distribution of the monomers throughout the polymer backbone.

The American Petroleum Institute has categorized base oils into five categories (API 1509, Appendix E). Classifications I-III are refined from petroleum crude oil. Group IV base oils are full synthetic (polyalphaolefin) oils. Group V is for other base oil which do not fall within any of Groups I-IV. Groups I-III can be distinguished as follows: Group I has less than 0.03 wt. % sulfur, and/or greater than 90 vol % saturates, with a viscosity index between 80 and 120. Group II has a sulfur content less than or equal 0.03 wt. %, and a saturate content of 90 vol % or greater, with a viscosity index between 80 and 120. Group III has a sulfur content less than or equal 0.03 wt. %, and a saturate content of 90 vol % or greater, with a viscosity index greater than 120.

The low viscosity base oil for use in the present invention is selected from API classifications I through IV. The kinematic viscosity of the low viscosity base oil at 40° C. should preferably be in the range of from 8 to less than 100 $mm^2/s$, more preferably in the range of 15 to 50 $mm^2/s$. The kinematic viscosity of the low viscosity base oil at 100° C. is preferably in the range of from 1.5 to 20 $mm^2/s$, more preferably in the range of from 2 to 15 $mm^2/s$, and still more preferably in the range of from 3 to 10 $mm^2/s$. The density of the low viscosity base oil is at 15° C. is preferably in the range of from 0.80 to 0.90 $g/cm^3$, more preferably in the range from 0.820 to 0.86 $g/cm^3$. It should be understood that two or more different kinds of low-viscosity base oils as described herein may also be used in combination.

In general, it has been found that Group I oils tend to be more soluble with the second component (that is, the ABA triblock polyalkylene glycol) than Group II oils, which are more soluble than Group III oils, which are more soluble than Group IV oils. Thus, Group IV oils tend to phase separate with the second component more easily than group I oils. This allows some ability to tailor the lubricant system depending on the particular second component chosen as well as the desired temperature for phase separation.

The second component of the lubricant systems of the present invention is an ABA triblock polyalkylene glycol derived from 1,2-propylene oxide as the A units and 1,2-butylene oxide as the B units. The ratio of units derived from propylene oxide to units derived from butylene oxide is in the range of 1/3 to 10/1 by weight (that is, units derived from BO make up from 10 percent to about 76 percent by weight of the second component), preferably in the range of from 1/3 to 3/1 by weight, more preferably in the range of 1/2 to 2/1 by weight.

The kinematic viscosity at 40° C. of the high viscosity polyalkylene glycol base oil is preferably in the range of from 100 to 20,000 $mm^2/s$, more preferably in the range of from 200 to 5000 $mm^2/s$ and still more preferably in the range of from 400 to 1000 $mm^2/s$. The 100° C. kinematic viscosity is preferably in the range of from 20 to 500 $mm^2/s$, more preferably in the range of from 50 to 400 $mm^2/s$ and still more preferably in the range of from 60 to 100 $mm^2/s$. The density at 15° C. of the high viscosity polyalkylene glycol base oil is preferably in the range of from 0.95 to 1.100 $g/cm^3$, more preferably in the range of from 0.960 to 1.05 $g/cm^3$. It should be understood that two or more different kinds of high viscosity base oils as described herein may also be used in combination.

Typically, the ABA triblock polyalkylene glycol for use as the high viscosity base oil of the present invention will have a molecular weight in the range of from 2000 to 8000 Daltons, preferably 4000 to 6000 Daltons, more preferably 4500 to 5500 Daltons, as determined from OH number measurements.

In general, it has been found that higher levels of BO in the ABA triblock polyalkylene glycol tends to increase solubility of the second component in the first component, which again allows some tailoring of the system to arrive at a lubricant system which demonstrates a good balance of efficiency and lubricity at different operating temperatures.

Typically, the lubricant systems of the present invention will comprise from 40 to 95, more preferably 50 to 85 percent by weight of the low viscosity base oil, and from 5 to 60, more preferably 15 to 50 percent by weight of the high viscosity oil. It should be understood that other oils or additives may be present in the lubricant systems such that the weight percentage of the first component and the second component do not have to add up to 100%, although that may be the case.

The lubricant systems of the present invention may advantageously include additives such as anti-wear agents, rust preventatives, metal deactivators, anti-hydrolysis agents, anti-static agents, defoamers, anti-oxidants, dispersants, detergents, extreme pressure additives, friction modifiers, viscosity index improvers, pour point depressants, tackifiers, metallic detergents, ashless dispersants and corrosion inhibitors, as in generally known in the art. In some embodiments the lubricant systems of the present invention may be characterized by the substantial absence ofany aliphatic ester.

The lubricant systems of the present invention may be further characterized by their ability to exhibit two phases at lover temperatures (for example, less than about 30° C., 35° C. or even 40° C.) but only one-phase at higher temperatures (for example, above about 100° C., 95° C. or even 90° C.).

Two phases can be evidenced by either a clear demarcation between the phases, or simply cloudiness or turbidity indicating that while the phases are not miscible, they have not had adequate time to fully form completely separate layers.

Examples

Table I describes materials which are used in the Examples.

TABLE I

| Base Oil | Description |
|---|---|
| UCON ™ OSP-680 (High viscosity base oil) | Diol initiated BO (100%) homo-polymer with a kinematic viscosity at 40° C. of 622.5 $mm^2$/sec and a kinematic viscosity at 100° C. and 68.8 $mm^2$/sec. It's density at 15° C. is 0.977 g/ml. |
| Experimental OSP-A (High viscosity base oil) | Diol initiated PO/BO (75/25 w/w) triblock copolymer with a kinematic viscosity at 40° C. of 628 $mm^2$/sec and a kinematic viscosity at 100° C. of 91.2 $mm^2$/sec. It's density at 15° C. is 0.998 g/ml. |
| Experimental OSP-B (High viscosity base oil) | Diol initiated PO/BO (50/50 w/w) triblock copolymer with a kinematic viscosity at 40° C. of 648 $mm^2$/sec and a kinematic viscosity at 100° C. of 86.2 $mm^2$/sec. It's density at 15° C. is 0.990 g/ml. |
| Experimental OSP-C (High viscosity base oil) | Diol initiated PO/BO (25/75 w/w) triblock copolymer with a kinematic viscosity at 40° C. of 736 $mm^2$/sec and a kinematic viscosity at 100° C. of 87.7 $mm^2$/sec. It's density at 15° C. is 0.984 g/ml. |
| Nexbase 3043 (Low viscosity base oil) | An API Group III hydrocarbon base oil with a kinematic viscosity at 40° C. of 19.9 $mm^2$/sec and a kinematic viscosity at 100° C. of 4.32 $mm^2$/sec and a density at 15° C. of 0.838 g/ml |
| Nexbase 3060 (Low viscosity base oil) | An API Group III hydrocarbon base oil with a kinematic viscosity at 40° C. of 31.9 $mm^2$/sec and a kinematic viscosity at 100° C. of 5.9 $mm^2$/sec and a density at 15° C. of 0.841 g/ml. |
| Nexbase 3080 (Low viscosity base oil) | An API Group III hydrocarbon base oil with a kinematic viscosity at 40° C. of 47.8 $mm^2$/sec and a kinematic viscosity at 100° C. of 7.8 $mm^2$/sec and a density at 15° C. of 0.844 g/ml. |
| Synfluid PAO-6 (Low viscosity base oil) | A polyalphaolefin with a kinematic viscosity at 40° C. of 29.2 $mm^2$/sec and a kinematic viscosity at 100° C. of 5.79 $mm^2$/sec and a density at 15° C. of 0.830 g/ml. This is an API Group IV hydrocarbon base oil |
| Synesstic 5 (Low viscosity base oil) | An alkylated naphthalene with a kinematic viscosity at 40° C. of 25.5 $mm^2$/sec and a kinematic viscosity at 100° C. of 4.77 $mm^2$/sec and a density at 15° C. of 0.911 g/ml. This is an API Group V hydrocarbon base oil |
| Experimental OSP-D (High viscosity base oil) | Diol initiated PO/BO (50/50 w/w) random copolymer with a kinematic viscosity at 40° C. of 434 $mm^2$/sec. |
| Experimental OSP-E (High viscosity base oil) | Diol initiated PO/BO (25/75 w/w) random copolymer with a kinematic viscosity at 40° C. of 554 $mm^2$/sec. |

Synthesis of Experimental Polymers

Synthesis of Exp. OSP-A (75/25 w/w PO/BO)

A 15 L conical reaction vessel, is equipped with magnetically coupled stirrer head and temperature control, and is charged with 163.3 g of P400 (a polypropylene glycol with a nominal molecular weight of 430 Daltons) and 20.0 g of 45% potassium hydroxide aqueous solution. This solution is stirred at 200 rpm and heated up to a temperature of 115° C. Vacuum is applied to keep the solution at 30 mBar in order to remove the water. Residual water is measured by means of Karl Fischer titration equipment, to be less than 1500 ppm after two hours at the above-mentioned conditions. The solution is cooled to 110° C. and nitrogen was introduced in the reactor to release vacuum.

The alkoxylation reaction is carried out in three steps. In the first step, 760 g of 1,2-propylene oxide are fed to the solution at a feed rate of 7 g/min at 110° C. while stirring at 320 rpm. After all the oxide is fed, the reaction is allowed to progress for a period of 5 h at 110° C. to digest all the oxide present. In the second step, 930 g of 1,2-butylene oxide are fed at feed rate of 7 g/min at 130° C. After all the oxide is fed, the reaction is allowed to progress for a period of 8 h at 130° C. to digest all the oxide present. In the third reaction step, 1870 g of 1,2-propylene oxide are fed at feed rate of 5 g/min at 110° C. After all the oxide is fed, the reaction is allowed to progress for a period of 18 h at 110° C. to digest all the oxide present. In all the three steps of the alkoxylation reaction, the pressure in the reaction vessel is closely monitored and oxide feed constraints are in place to ensure that a pressure of 3.5 bar is not exceeded.

The solution is then cooled to 80° C. and mixed with 102 g of magnesium silicate at stirring rate of 350 rpm for 1 h. The resulting solution is subsequently unloaded from the reactor and transferred to a porcelain Buchner filter funnel with a paper filter with pore size of 20 μm and filtered under vacuum. A vacuum of less than 0.3 bar is maintained over the filtrate for 6 h to give a clear solution.

Synthesis Exp. OSP-B (50/50 w/w PO/BO)

A 15 L conical reaction vessel, is equipped with magnetically coupled stirrer head and temperature control, and is charged with 333.7 g of P400 and 29.7 g of 45% potassium hydroxide aqueous solution. This solution is stirred at 200 rpm and heated up to a temperature of 115° C. Vacuum is applied to keep the solution at 30 mBar in order to remove the water. Residual water is measured, by means of Karl Fischer titration equipment, to be less than 1500 ppm after two hours at the above-mentioned conditions. The solution is cooled to 110° C. and nitrogen is introduced in the reactor to release vacuum.

The alkoxylation reaction is carried out in three steps. In the first step, 435 g of 1,2-propylene oxide are fed to the solution at a feed rate of 7 g/min at 110° C. while stirring at 320 rpm. After all the oxide is fed, the reaction is allowed to progress for a period of 6 h at 110° C. to digest all the oxide present. In the second step, 3169 g of 1,2-butylene oxide are fed at feed rate of 10 g/min at 130° C. After all the oxide is fed, the reaction is allowed to progress for a period of 14 h at 130° C. to digest all the oxide present. In the third reaction step, 1915 g of 1,2-propylene oxide are fed at feed rate of 5 g/min at 110° C. After all the oxide is fed, the reaction is allowed to progress for a period of 14 h at 110° C. to digest all the oxide present. In all the three steps of the alkoxylation reaction, the pressure in the reaction vessel is closely monitored and oxide feed constraints are in place to ensure that a pressure of 3.5 bar is not exceeded.

The solution is then cooled to 80° C. and mixed with 104 g of magnesium silicate at stirring rate of 350 rpm for 1 h. The resulting solution is subsequently unloaded from the reactor and transferred to a porcelain Buchner filter funnel with a paper filter with pore size of 20 μm and filtered under vacuum. A vacuum of less than 0.3 bar is maintained over the filtrate for 7 h to give a clear solution.

Synthesis of Exp. OSP C (25/75 w/w PO/BO)

A 15 L conical reaction vessel equipped with magnetically coupled stirrer head and temperature control, is charged with 201.5 g of P400 and 24.6 g of 45% potassium hydroxide aqueous solution. This solution is stirred at 200 rpm and heated up to a temperature of 115° C. Vacuum is applied to keep the solution at 30 mBar in order to remove the water. Residual water is measured, by means of Karl Fischer titration equipment, to be less than 1500 ppm after two hours at the above-mentioned conditions. The solution is cooled to 110° C. and nitrogen is introduced in the reactor to release vacuum.

The alkoxylation reaction is carried out in three steps. In the first step, 285 g of 1,2-propylene oxide are fed to the solution at a feed rate of 10 g/min at 110° C. while stirring at 320 rpm. After all the oxide is fed, the reaction is allowed to progress for a period of 6 h at 110° C. to digest all the oxide present. In the second step, 2910 g of 1,2-butylene oxide are fed at feed rate of 7 g/min at 130° C. After all the oxide is fed, the reaction is allowed to progress for a period of 12 h at 130° C. to digest all the oxide present. In the third reaction step, 485 g of 1,2-propylene oxide are fed at feed rate of 5 g/min at 110° C. After all the oxide is fed, the reaction is allowed to progress for a period of 14 h at 110° C. to digest all the oxide present. In all the three steps of the alkoxylation reaction, the pressure in the reaction vessel is closely monitored and oxide feed constraints are in place to ensure that a pressure of 3.5 bar is not exceeded.

The solution is then cooled to 80° C. and mixed with 104 g of magnesium silicate at stirring rate of 350 rpm for 1 h. The resulting solution is subsequently unloaded from the reactor and transferred to a porcelain Buchner filter funnel with a paper filter with pore size of 20 μm and filtered under vacuum. A vacuum of less than 0.3 bar is maintained over the filtrate for 7 h to give a clear solution.

Synthesis of Exp. OSP D (50/50 w/w PO/BO)

A 15 L conical reaction vessel equipped with magnetically coupled stirrer head and temperature control, is charged with 234 g of B700 (polybutylene glycol with nominal MW of 700 Da) and 18.3 g of 45% potassium hydroxide aqueous solution. This solution is stirred at 200 rpm and heated up to a temperature of 115° C. Vacuum is applied to keep the solution at 30 mBar in order to remove the water. Residual water is measured, by means of Karl Fischer titration equipment, to be less than 1500 ppm after two hours at the above-mentioned conditions. The solution is cooled to 110° C. and nitrogen is introduced in the reactor to release vacuum.

The alkoxylation reaction is carried out in one step. 2042 g of 1,2-propylene oxide and 1851 g of 1,2-butylene oxide are co-fed to the solution at a feed rate of 12 g/min at 130° C. while stirring at 320 rpm. After all the oxide is fed, the reaction is allowed to progress for a period of 4 h at 130° C. to digest all the oxide present. During the alkoxylation reaction, the pressure in the reaction vessel is closely monitored and oxide feed constraints are in place to ensure that a pressure of 3.5 bar is not exceeded.

The solution is then cooled to 80° C. and mixed with 90 g of magnesium silicate at stirring rate of 350 rpm for 1 h. The resulting solution is subsequently unloaded from the reactor and transferred to a porcelain Buchner filter funnel with a paper filter with pore size of 20 μm and filtered under vacuum. A vacuum of less than 0.3 bar is maintained over the filtrate for 7 h to give a clear solution.

Synthesis of Exp. OSP E (25/75 w/w PO/BO)

A 15 L conical reaction vessel equipped with magnetically coupled stirrer head and temperature control, is charged with 248.5 g of B700 (polybutylene glycol with nominal MW of 700 Da) and 19.1 g of 45% potassium hydroxide aqueous solution. This solution is stirred at 200 rpm and heated up to a temperature of 115° C. Vacuum is applied to keep the solution at 30 mBar in order to remove the water. Residual water is measured, by means of Karl Fischer titration equipment, to be less than 1500 ppm after two hours at the above-mentioned conditions. The solution is cooled to 110° C. and nitrogen is introduced in the reactor to release vacuum.

The alkoxylation reaction is carried out in one step. 888 g of 1,2-propylene oxide and 2493 g of 1,2-butylene oxide are co-fed to the solution at a feed rate of 14 g/min at 130° C. while stirring at 320 rpm. After all the oxide is fed, the reaction is allowed to progress for a period of 4 h at 130° C. to digest all the oxide present. During the alkoxylation reaction, the pressure in the reaction vessel is closely monitored and oxide feed constraints are in place to ensure that a pressure of 3.5 bar is not exceeded.

The solution is then cooled to 80° C. and mixed with 95 g of magnesium silicate at stirring rate of 350 rpm for 1 h. The resulting solution is subsequently unloaded from the reactor and transferred to a porcelain Buchner filter funnel with a paper filter with pore size of 20 μm and filtered under vacuum. A vacuum of less than 0.3 bar is maintained over the filtrate for 7 h to give a clear solution.

Preparation of Blends.

100 mls of each lubricant composition is prepared by adding each component into a 200 ml glass beaker using the weight percentages shown in the Tables below. The blends are stirred at ambient temperature using a magnetic stirrer. Some blends form homogenous, clear, one-phase compositions. For the blends that did not form a homogeneous one-phase compositions and instead appeared as two-phases at ambient temperature, their separation temperatures are measured according to the procedure shown below.

Measurement of the Separation Temperature and Kinematic Viscosities

The separation temperature is only measured on compositions that exhibit two-phases (either separate phases or observance of cloudiness or turbidity) at room temperature.

In a 100 ml beaker fitted with a thermometer and magnetic stirrer, add 50 ml of lubricant composition at room temperature. Heat with stirring to 120° C. over a 10-15 minute period and then turn off the heat and allow the lubricant composition to cool to room temperature. If the solution clouds or shows visual separation into two phases, record the temperature at which this occurs as the Separation Temperature. When the temperature is 40° C., take a sample from the top layer (called the supernatant) if it has separated into two phases and measure its kinematic viscosity at 40° C. If it did not separate at 40° C., simply measure the kinematic viscosity at 40° C. of the homogeneous one phase composition. Measure also the kinematic viscosity at 100° C. of the homogeneous one phase blend.

Inventive Examples (Ex.) and Comparative Examples (C.Ex) are presented below, separated into different table according to the low viscosity oil and high viscosity base oils chosen.

TABLE 2

| UCON OSP-680 in an alkylated naphthalene | | | | |
|---|---|---|---|---|
| | C. Ex % | C. Ex % | C. Ex % | C. Ex % |
| UCON OSP-680 (100% BO) | 50 | 25 | 10 | 5 |
| Synesstic 5 | 50 | 75 | 90 | 95 |
| Solubility at room temp. | clear, homogeneous | clear, homogeneous | clear, homogeneous | clear, homogeneous |
| Kin. viscosity 40° C. cSt | 162.9 | 73.9 | 40.8 | 33.6 |
| Kin. viscosity at 40° C. of supernatant (top layer), cSt | | | | |
| Kin. Viscosity of at 100° C., cSt of the Blend | 22.2 | 11.6 | 6.93 | 5.80 |
| Separation temperature, ° C. | No separation | No separation | No separation | No separation |
| VI (for homogeneous blends) | 163 | 150 | 129 | 114 |
| Pseudo VI (for two phase blends) | | | | |

TABLE 3

| Exp. OSP-A in an alkylated naphthalene | | | | |
|---|---|---|---|---|
| | C. Ex % | C. Ex % | C. Ex % | C. Ex % |
| Exp OSP-A (75/25 w/w PO/BO) | 50 | 25 | 10 | 5 |
| Synesstic 5 | 50 | 75 | 90 | 95 |
| Solubility at room temp. | clear, homogeneous | clear, homogeneous | clear, homogeneous | clear, homogeneous |
| Kin viscosity 40° C. cSt | 175.3 | 76.2 | 42.4 | 34.2 |
| Kin viscosity at 40° C. of supernatant (top layer), cSt | | | | |
| Kin Viscosity of at 100° C., cSt of the Blend | 27.4 | 12.8 | 7.41 | 5.99 |
| Separation temperature, ° C. | No separation | No separation | No separation | No separation |
| VI (for homogeneous blends) | 194 | 169 | 141 | 121 |
| Pseudo VI (for two phase blends) | | | | |

VI = Viscosity index

TABLE 4

| Exp. OSP-B in an alkylated naphthalene | | | | |
|---|---|---|---|---|
| | C. Ex % | C. Ex % | C. Ex % | C. Ex % |
| Exp OSP-B (50/50 w/w PO/BO) | 50 | 25 | 10 | 5 |
| Synesstic 5 | 50 | 75 | 90 | 95 |
| Solubility at room temp. | clear, homogeneous | clear, homogeneous | clear, homogeneous | clear, homogeneous |
| Kin, viscosity 40° C. cSt | 183.4 | 77.9 | 42.5 | 34.3 |
| Kin. viscosity at 40° C. of supernatant (top layer), cSt | | | | |
| Kin. Viscosity of at 100° C., cSt of the Blend | 27.0 | 12.6 | 7.33 | 5.97 |
| Separation temperature, ° C. | No separation | No separation | No separation | No separation |
| VI (for homogeneous blends) | 184 | 161 | 137 | 119 |
| Pseudo VI (for two phase blends) | | | | |

TABLE 5

| Exp. OSP-C in an alkylated naphthalene | | | | |
|---|---|---|---|---|
| | C. Ex % | C. Ex % | C. Ex % | C. Ex % |
| Exp OSP-C (25/75 w/w PO/BO) | 50 | 25 | 10 | 5 |
| Synesstic 5 | 50 | 75 | 90 | 95 |
| Solubility at room temp. | clear, homogeneous | clear, homogeneous | clear, homogeneous | clear, homogeneous |
| Kin. viscosity 40° C. cSt | 182.4 | 77.3 | 43.5 | 34.4 |
| Kin. viscosity at 40° C. of supernatant (top layer), cSt | | | | |
| Kin. Viscosity of at 100° C., cSt | 26.2 | 12.4 | 7.40 | 6.02 |
| Separation temperature, ° C. | No separation | No separation | No separation | No separation |
| VI (for homogeneous blends) | 179 | 159 | 135 | 121 |
| Pseudo VI (for two phase blends) | | | | |

TABLE 6

| UCON OSP-680 in an API Group III Base Oil | | | | |
|---|---|---|---|---|
| | C. Ex % | C. Ex % | C. Ex % | C. Ex % |
| UCON OSP-680 (100% BO) | 50 | 25 | 10 | 5 |
| Nexbase 3043 | 50 | 75 | 90 | 95 |
| Solubility at room temp. | clear, homogeneous | clear, homogeneous | clear, homogeneous | clear, homogeneous |
| Kin viscosity 40° C. cSt | 104.5 | 44.2 | 27.6 | 23.7 |
| Kin viscosity at 40° C. of supernatant (top layer), cSt | | | | |
| Kin Viscosity of at 100° C., cSt of the Blend | 17.9 | 9.02 | 5.80 | 5.03 |
| Separation temperature, ° C. | No separation | No separation | No separation | No separation |
| VI (for homogeneous blends) | 190 | 191 | 161 | 145 |
| Pseudo VI (for two phase blends) | | | | |

TABLE 7

| Exp. OSP-A in an API Group III Base Oil | | | | |
|---|---|---|---|---|
| | Ex % | Ex % | Ex % | Ex % |
| Exp OSP-A (75/25 w/w PO/BO) | 50 | 25 | 10 | 5 |
| Nexbase 3043 | 50 | 75 | 90 | 95 |
| Solubility at room temp. | turbid, 2-phases | turbid, 2-phases | turbid, 2-phases | turbid, 2-phases |
| Kin. Viscosity 40° C. cSt | | | | |
| Kin. viscosity at 40° C. of supernatant (top layer), cSt | 21.3 | 21.1 | 19.8 | 19.8 |
| Kin. Viscosity of at 100° C., cSt of the Blend | 21.1 | 10.4 | 6.08 | 5.16 |
| Separation temperature, ° C. | 74.4 | 76 | 73.4 | 70 |
| VI (for homogeneous blends) | | | | |
| Pseudo VI (for two phase blends) | 855 | 528 | 291 | 211 |

TABLE 8

| Exp. OSP-B in an API Group III Base Oil | | | | |
|---|---|---|---|---|
| | Ex. % | Ex. % | Ex. % | Ex. % |
| Exp OSP-B (50/50 w/w PO/BO) | 50 | 25 | 10 | 5 |
| Nexbase 3043 | 50 | 75 | 90 | 95 |
| Solubility at room temp. | turbid 2 phases | turbid 2 phases | turbid 2 phases | turbid 2 phases |
| Kin. viscosity 40° C. cSt | | | | |
| Kin. viscosity at 40° C. of supernatant (top layer), cSt | 24.7 | 21.9 | 21.7 | 21.1 |
| Kin. Viscosity of at 100° C., cSt of the Blend | 20.8 | 10.0 | 6.08 | 5.15 |
| Separation temperature, ° C. | 41.3 | 45 | 40.5 | 47 |
| VI (for homogeneous blends) | | | | |
| Pseudo VI (for two phase blends) | 754 | 491 | 256 | 190 |

TABLE 9

| Exp. OSP-C in an API Group III Base Oil | | | | |
|---|---|---|---|---|
| | C. Ex % | C. Ex % | C. Ex % | C. Ex % |
| Exp OSP-C (25/75 w/w PO/BO) | 50 | 25 | 10 | 5 |
| Nexbase 3043 | 50 | 75 | 90 | 95 |
| Solubility at room temp. | clear, homogeneous | clear, homogeneous | clear, homogeneous | clear, homogeneous |
| Kin. Viscosity 40° C. cSt | 114.6 | 46.6 | 27.4 | 23.1 |
| Kin viscosity at 40° C. of supernatant (top layer), cSt | | | | |
| Kin Viscosity of at 100° C., cSt of the Blend | 20.6 | 9.75 | 5.97 | 5.02 |
| Separation temperature, ° C. | | | | |
| VI (for homogeneous blends) | 206 | 201 | 173 | 150 |
| Pseudo VI (for two phase blends) | | | | |

TABLE 10

| UCON OSP-680 in an API Group IV Base Oil | | | | |
|---|---|---|---|---|
| | C. Ex % | C. Ex % | C. Ex % | C. Ex % |
| UCON OSP-680 (100% BO) | 50 | 25 | 10 | 5 |
| Synfluid PAO-6 | 50 | 75 | 90 | 95 |
| Solubility at room temp. | clear, homogeneous | clear, homogeneous | clear, homogeneous | clear, homogeneous |
| Kin. Viscosity 40° C. cSt | 129.1 | 59.6 | 38.3 | 33.5 |
| Kin. viscosity at 40° C. of supernatant (top layer), cSt | | | | |
| Kin. Viscosity of at 100° C., cSt of the Blend | 20.8 | 11.1 | 7.56 | 6.58 |
| Separation temperature, ° C. | | | | |
| VI (for homogeneous blends) | 186 | 182 | 170 | 156 |
| Pseudo VI (for two phase blends) | | | | |

TABLE 11

| Exp. OSP-A in an API Group IV Base Oil | | | | |
|---|---|---|---|---|
| | Ex. % | Ex. % | Ex. % | Ex. % |
| Exp OSP-A (75/25 w/w PO/BO) | 50 | 25 | 10 | 5 |
| Synfluid PAO-6 | 50 | 75 | 90 | 95 |

TABLE 11-continued

| Exp. OSP-A in an API Group IV Base Oil | | | | |
|---|---|---|---|---|
| | Ex. % | Ex. % | Ex. % | Ex. % |
| Solubility at room temp. | turbid 2 phases | turbid 2 phases | turbid 2 phases | turbid 2 phases |
| Kin. Viscosity 40° C. cSt | | | | |
| Kin. viscosity at 40° C. of supernatant (top layer), cSt | 31.0 | 29.1 | 29.0 | 29.1 |
| Kin. Viscosity of at 100° C., cSt of the Blend | 26.4 | 14.9 | 8.10 | 6.74 |
| Separation temperature, ° C. | 95.7 | 105 | 100 | 96.6 |
| VI (for homogeneous blends) | | | | |
| Pseudo VI (for two phase blends) | 727 | 521 | 276 | 201 |

15

TABLE 12

| Exp. OSP-B in an API Group IV Base Oil | | | | |
|---|---|---|---|---|
| | Ex. % | Ex. % | Ex. % | Ex. % |
| Exp OSP-B (50/50 w/w PO/BO) | 50 | 25 | 10 | 5 |
| Synfluid PAO-6 | 50 | 75 | 90 | 95 |
| Solubility at room temp. | turbid 2 phases | turbid 2 phases | turbid 2 phases | turbid 2 phases |
| Kin. Viscosity 40° C. cSt | | | | |
| Kin. viscosity at 40° C. of supernatant (top layer), cSt | 29.9 | 30.1 | 29.3 | 29.5 |
| Kin. Viscosity of at 100° C., cSt of the Blend | 23.6 | 12.1 | 7.82 | 6.74 |
| Separation temperature, ° C. | 68 | 71.8 | 65.2 | 67.2 |
| VI (for homogeneous blends) | | | | |
| Pseudo VI (for two phase blends) | 699 | 422 | 258 | 198 |

TABLE 13

| Exp. OSP-C in an API Group IV Base Oil | | | | |
|---|---|---|---|---|
| | Ex. % | Ex. % | Ex. % | Ex. % |
| Exp OSP-C (25/75 w/w PO/BO) | — | 25 | 10 | 5 |
| Synfluid PAO-6 | — | 75 | 90 | 95 |
| Solubility at room temp. | — | Cloudy 2 phases | Cloudy 2 phases | Cloudy 2 phases |
| Kin. Viscosity 40° C., cSt | | | | |
| Kin. viscosity at 40° C. of supernatant (top layer), cSt | —* | 32.6 | 34.1 | 32.1 |
| Kin. Viscosity of at 100° C., cSt of the Blend | — | 12.4 | 7.90 | 6.78 |
| Separation temperature, ° C. | — | 44.6 | 43.3 | 44.2 |
| VI (for homogeneous blends) | | | | |
| Pseudo VI (for two phase blends) | — | 397 | 216 | 177 |

*The phase separation temperature is very close to the sampling temperature (40° C.), therefore the sample status is not very stable.

TABLE 14

| UCON OSP-680 in an API Group III Base Oil | | | | |
|---|---|---|---|---|
| | C. Ex % | C. Ex % | C. Ex % | C. Ex % |
| UCON OSP-680 (100% BO) | 50 | 25 | 10 | 5 |
| Nexbase 3080 | 50 | 75 | 90 | 95 |
| Solubility at room temp. | clear, homogeneous | clear, homogeneous | clear, homogeneous | clear, homogeneous |
| Kin. viscosity 40° C. cSt | 163.7 | 85.2 | 56.2 | 52.5 |
| Kin. viscosity at 40° C. of supernatant (top layer), cSt | | | | |

TABLE 14-continued

| UCON OSP-680 in an API Group III Base Oil | | | | |
|---|---|---|---|---|
| | C. Ex % | C. Ex % | C. Ex % | C. Ex % |
| Kin. Viscosity of at 100° C. cSt of the Blend | 23.9 | 13.9 | 9.72 | 9.11 |
| Separation temperature, ° C. | No separation | No separation | No separation | No separation |
| VI (for homogeneous blends) | 177 | 168 | 159 | 156 |
| Pseudo VI (for two phase blends) | | | | |

TABLE 15

| Exp. OSP-B in an API Group III Base Oil | | | | |
|---|---|---|---|---|
| | Ex. % | Ex. % | Ex. % | Ex. % |
| Exp OSP-B (50/50 w/w PO/BO) | 50 | 25 | 10 | 5 |
| Nexbase 3080 | 50 | 75 | 90 | 95 |
| Solubility at room temp. | turbid 2-phases | turbid 2-phases | turbid 2-phases | turbid 2-phases |
| Kin. viscosity 40° C. cSt | | | | |
| Kin. viscosity at 40° C. of supernatant (top layer), cSt | 47.0 | 46.8 | 45.9 | 46.6 |
| Kin. Viscosity of at 100° C., cSt of the Blend | 27.5 | 15.2 | 10.1 | 9.11 |
| Separation temperature, ° C. | 80.5 | 82.6 | 78.9 | 76.5 |
| VI (for homogeneous blends) | | | | |
| Pseudo VI (for two phase blends) | 546 | 339 | 216 | 181 |

TABLE 16

| Comparison of Random and ABA Triblock Polyalkylene Glycols | | | | | |
|---|---|---|---|---|---|
| | C. Ex OSP-E | C. Ex OSP-D | Ex. Exp. OSP-C | Ex. Exp. OSP-B | Ex. Exp. OSP-A |
| PO/BO ratio | 25/75 | 50/50 | 25/75 | 50/50 | 75/25 |
| Structure type | Random | Random | Triblock | Triblock | Triblock |
| Theoretical MW, g/mol | 9990 | 12063 | 8379 | 7630 | 10095 |
| KV40, cSt | 554 | 434 | 736 | 648 | 628 |

Exp OSP-A with Group III base oil in Table 7, Exp OSP-B with Group III base oil in Table 8, Exp OSP-A with Group IV base oil in Table 11, Exp OSP-B with Group IV base oil in Table 12, and Exp OSP-C with Group IV base oil in Table 14 all exhibit the similar phase separation temperature respectively, while the mixture viscosity and VI could be increased if desired by increasing the high-viscosity PAG component dosage. While Exp OSP-C with a Group III base oil in Table 9 did not show separation as formulated, it is believed that this example could be made to have separation at lower temperatures by either moving to a higher classification level IV for the low viscosity base oil or reducing the relative amount of BO in the ABA triblock high viscosity component.

Considering the higher viscosity of the high-viscosity PAG polymer used in the two phase lubricant, the higher VI could be achieved at the same dosage of such PAG polymer, it's highly desirable to use the high-viscosity PAG with kinematic viscosity greater than 600 cst at 40° C. As the random polymers (OSP-D and OSP-E) produced did not meet this goal, they were not tested with the low viscosity component for determination as to whether they would exhibit the desired phase separation characteristics.

In the case of the examples described in Table 16, the Exp. OSP-C exhibited a significantly higher viscosity vs comparative example OSP-E at a significantly lower theoretical MW, and the Exp. OSP-B exhibited a significantly higher viscosity vs comparative example OSP-D at a significantly lower theoretical MW. It is believed that for the normal synthesis route of the PO/BO copolymer (that is, a copolymer formed by random addition of PO and BO units), it would be very difficult to achieve the kinematic viscosity greater than 600 cst at 40° C., since the side reaction (unsaturation by isomerization of PO and BO) can initiate the alkoxylation thus limiting molecular weight build-up and, hence, the viscosity. The Exp. OSP-A, OSP-B and OSP-C feed the PO and the BO separately at different temperatures. It is believed that since PO is fed at 110° C. it results in lower unsaturation and higher MW and, hence higher viscosity.

The invention claimed is:

1. A lubricant system comprising a low viscosity base oil and a high viscosity base oil where the low viscosity base oil is a hydrocarbon oil falling within the American Petroleum Institutions' classification I to IV, and the high viscosity base oil is an ABA triblock polyalkylene glycol derived from 1,2-propylene oxide as the A units and 1,2-butylene oxide as the B units, and wherein the ratio of units derived from propylene oxide to units derived from butylene oxide is in the range of 1/3 to 10/1 by weight.

2. The lubricant system of claim 1 where the ratio of units derived from propylene oxide to units derived from butylene oxide is in the range of 1/3 to 3/1 by weight.

3. The lubricant system of claim 1 where the ratio of units derived from propylene oxide to units derived from butylene oxide is in the range of 1/2 to 2/1 by weight.

4. The lubricant system of claim 1 where the low viscosity base oil is an API Group IV oil.

5. The lubricant system of claim 1 where the ABA triblock polyalkylene glycol has a molecular weight in the range of from 2000 to 8000 Daltons.

6. The lubricant system of claim 1 where the low viscosity base oil comprises from 40 to 95 percent by weight of the system.

7. The lubricant system of claim 1 where the low viscosity base oil has a kinematic viscosity at 40° C. in the range of from 8 to less than 100 $mm^2/s$.

8. The lubricant system of claim 7 where the low viscosity base oil has a kinematic viscosity at 40° C. in the range of from 15 to 50 $mm^2/s$.

9. The lubricant system of claim 1 where the high viscosity base oil has a kinematic viscosity at 40° C. in the range of from 100 $mm^2/s$ to 20,000 $mm^2/s$.

10. The lubricant system of claim 1 where the high viscosity base oil has a kinematic viscosity at 40° C. in the range of from 400 $mm^2/s$ to 1,000 $mm^2/s$.

11. The lubricant system of claim 1 where the low viscosity base oil has a density at 15° C. in the range of from 0.80 to 0.90 $g/cm^3$.

12. The lubricant system of claim 1 where the high viscosity base oil has a density at 15° C. in the range of from 0.95 to 1.10 $g/cm^3$.

* * * * *